US007341388B2

(12) United States Patent
Carroll

(10) Patent No.: US 7,341,388 B2
(45) Date of Patent: Mar. 11, 2008

(54) RETRACTABLE WRITING INSTRUMENTS WITH VOLATILE INKS

(75) Inventor: Craig D. Carroll, Newport Coast, CA (US)

(73) Assignee: Avery Dennison Corporation, Pasadena, CA (US)

( * ) Notice: Subject to any disclaimer, the term of this patent is extended or adjusted under 35 U.S.C. 154(b) by 366 days.

(21) Appl. No.: 10/864,096

(22) Filed: Jun. 8, 2004

(65) Prior Publication Data

US 2005/0084320 A1 Apr. 21, 2005

Related U.S. Application Data

(60) Provisional application No. 60/512,961, filed on Oct. 20, 2003.

(51) Int. Cl.
*B43K 24/02* (2006.01)

(52) U.S. Cl. ..... 401/107

(58) Field of Classification Search ..... 401/99, 401/107, 108

See application file for complete search history.

(56) References Cited

U.S. PATENT DOCUMENTS

| | | | | |
|---|---|---|---|---|
| 3,525,573 | A * | 8/1970 | Kurt | 401/108 |
| 4,969,764 | A * | 11/1990 | Gregory | 401/108 |
| 5,022,773 | A | 6/1991 | Waldinger et al. | |
| 5,915,867 | A | 6/1999 | Hashimoto | |
| 6,033,141 | A | 3/2000 | Blaustein et al. | |
| 7,059,796 | B2 * | 6/2006 | Lewis et al. | 401/107 |

FOREIGN PATENT DOCUMENTS

| | | |
|---|---|---|
| DE | 1561825 | 3/1972 |
| DE | 4305082 A1 | 8/1994 |
| EP | 0149747 A1 | 7/1985 |
| WO | WO 89/00925 | 2/1989 |
| WO | WO 00/44573 | 8/2000 |

OTHER PUBLICATIONS

Report PCT/US2004/018335 Jun. 21, 2005.

* cited by examiner

*Primary Examiner*—David J. Walczak
(74) *Attorney, Agent, or Firm*—Ingrassia Fisher & Lorenz, P.C.

(57) ABSTRACT

A retractable writing instrument may include a barrel having a front opening, a nib for moving through the front opening of the barrel between an extended position and a retracted position, a cartridge for receiving the nib and for folding a supply of ink, and a seal assembly received within the barrel through which the nib is passable. In a number of embodiments, when the nib is in the retracted position, the seal assembly is biased closed to seal the front of the retractable writing instrument. In addition, an outer surface of the cartridge may contact the seal assembly to form a rear seal such that a tip of the nib is positioned within the body member between the two seals. Accordingly, in these embodiments, the nib is sealed from ambient air when in the retracted position, thereby minimizing evaporation of ink from the cartridge. IN addition, the nib may be urged through the seal assembly while moving to the extended position to open the front of the retractable writing instrument. The rear seal may be opened prior to the nib breaking the front seal to form a vent between the cartridge and the body member. The seal assembly may include a spring member and a body member, with the spring member biasing the body member closed when the nib is in the retracted position. The body member may include an arcuate gate through which a slit is formed.

43 Claims, 12 Drawing Sheets

RETRACTABLE WRITING INSTRUMENTS WITH VOLATILE INKS

CROSS REFERENCE TO RELATED APPLICATIONS

The present invention claims priority benefits under 35 U.S.C. § 119(e) on U.S. Provisional Application for Patent Ser. No. 60/512,961 filed on Oct. 20, 2003, which application is incorporated herein by reference.

BACKGROUND OF THE INVENTION

1. Field of the Invention

The present invention relates to writing instruments and, in particular, to capless writing instruments in which a nib is retractable and protractible.

2. Description of the Related Art

Conventional writing instruments can typically include a body for holding a supply of ink, a tip adapter for securing a writing tip, and a cap fitting on the tip adapter for protecting the writing tip and for preventing the ink from drying out. To use the writing instrument, the cap is removed from the tip adapter and, in some cases, can be stored on a back of the body. To store the writing instrument, the cap is replaced on the tip adapter.

Writing instruments such as highlighters, markers, and dry-erase markers may use volatile inks. Accordingly, these types of markers have tightly sealed caps to minimize evaporation of the inks. Failure to replace the cap tightly can result in the evaporation of the ink solvents, thereby reducing the life span of the marker.

A capped writing instrument with volatile ink also requires two-hand operation for removing and replacing its cap. A retractable ball-point pen is also known in the art. However, the retractable ball-point pen has ink of a lesser volatility, and its mechanism would allow more volatile ink to dry out even if the bin is retracted. One specific example of a writing instrument that attempts to address this problem is shown in U.S. Pat. No. 6,033,141 to Blaustein et al. in which a seal used in the writing instrument. Other retractable instruments with volatile inks have been known, but in general, these instruments have failed to meet the needs of consumers for an inexpensive and reliable writing instrument.

In view of the foregoing, there remains a need in the art for an inexpensive retractable writing instrument which is able to reliable and adequately seal a nib when not in use to minimize evaporation of volatile marker and highlighter inks. The present invention satisfies one or more of these needs.

BRIEF SUMMARY OF THE INVENTION

The present invention relates to writing instruments and, in particular, to capless writing instruments in which a nib is retractable and protractible.

According to one of the embodiments and by way of example only, a writing instrument may include a barrel having a front opening, a nib movable through the front opening of the barrel between a retracted position and an extended position, and a seal assembly located within the barrel. The seal assembly may include a body member having a movable gate capable of forming an opening through which the nib may extend. The movable gate separates the nib from ambient air flow from the front opening of the barrel when the nib is in the retracted position. In a number of embodiments, the movable gate may be biased in a closed position and may have a dimension when in the closed position that is at least about 1.8 times less than the corresponding dimension of the nib.

In other embodiments, the writing instrument may include a cartridge containing a supply of ink and in which the nib is received. An outer surface of the cartridge may contact an inner surface of the body member to form a rear seal such that a tip of the nib is positioned within the body member between the two seals. Accordingly, in these embodiments, the nib is sealed from ambient air when in the retracted position, thereby minimizing evaporation of ink from the cartridge.

In other embodiments in which the nib is urged through the slit while moving to the extended position to break the front seal, the rear seal may be broken prior to the nib breaking the front seal to form a vent between the cartridge and the body member. In these embodiments, any increase gas present within the body member may exhaust through the vent into the barrel and not through the slit. In still other embodiments, the cartridge may include an annular chamfer and the body member may include an annular collar to facilitate the formation of the rear seal.

In many of the embodiments, a spring member may be provided for biasing the slit in a closed position when the nib is in the retracted position. More specifically, the spring member may include a pair of arms that are biased closed and configured to urge the slit in a closed position. Other embodiments include a body member which has an arcuate movable gate through which the slit is formed. In these embodiments, the movable gate may have a dimension when closed that is at least about 1.8 times less than a corresponding dimension of the nib.

Other features and advantages of the present invention will become apparent to those skilled in the art from a consideration of the following detailed description taken in conjunction with the accompanying drawings.

DETAILED DESCRIPTION OF THE INVENTION

Figure 1A:
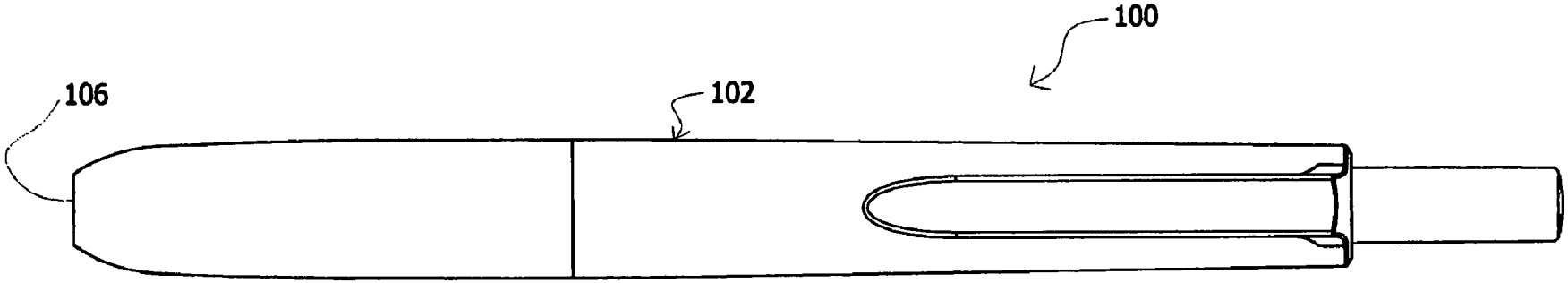
FIGS. 1A and 1B respectively illustrate a capless writing instrument in a retracted position when not in use and an extended position for in use.
Figure 1B:
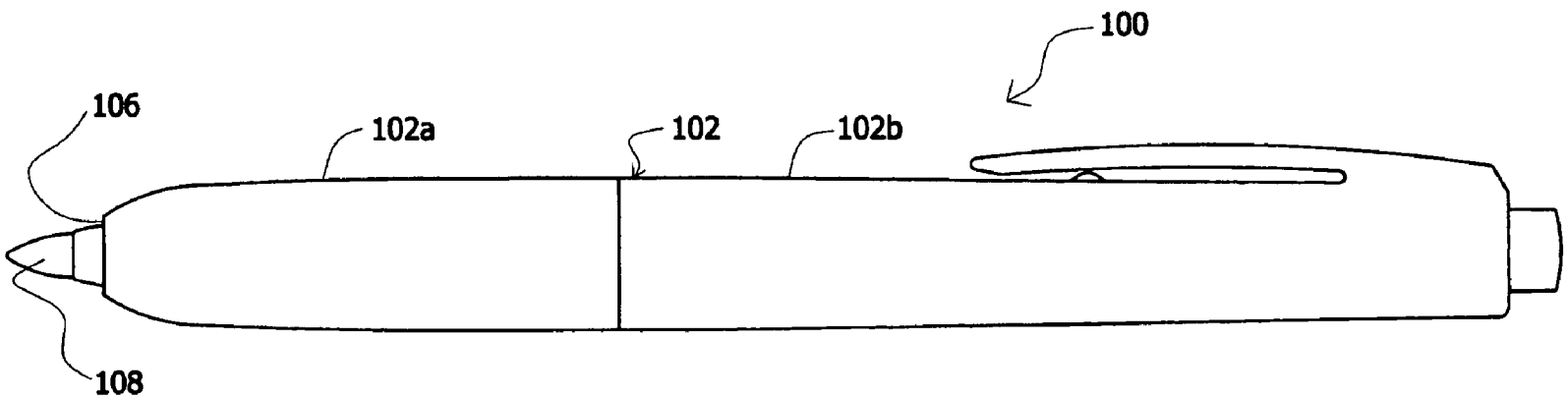
Figure 2A:
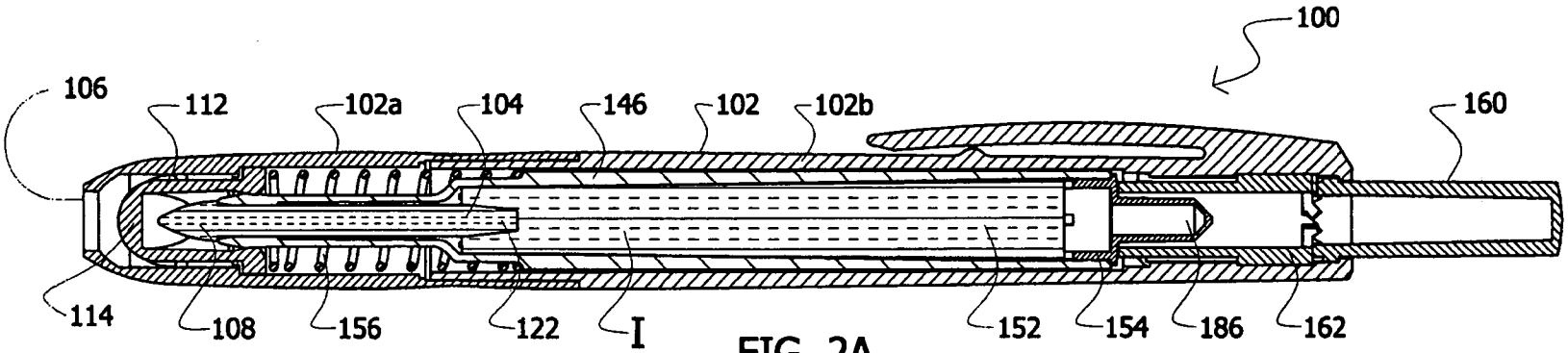
FIGS. 2A and 2B are cross-sectional views respectively illustrating a writing instrument in a retracted position with a nib being sealed from ambient air and an extended position with the nib ready for writing.
Figure 2B:
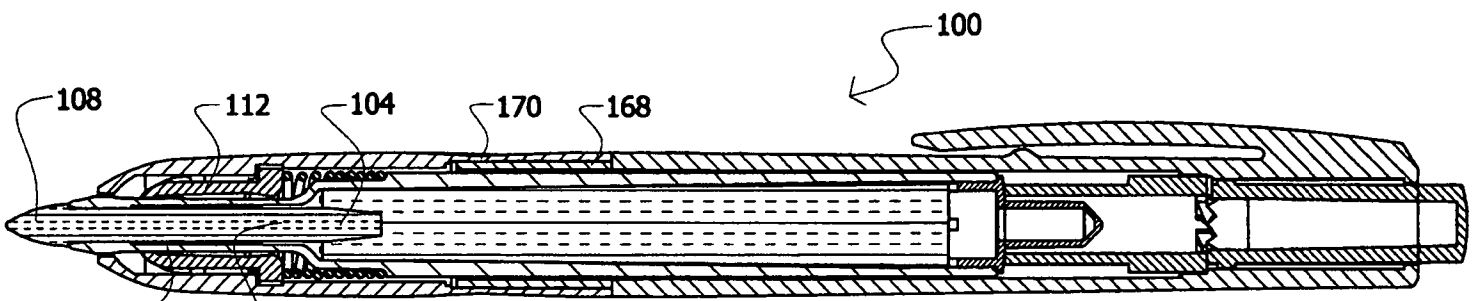

According to embodiments as illustrated in FIGS. 1 and 2 of the drawings, a writing instrument 100 may include a barrel 102 and a nib 104. The barrel 102 may have a front opening 106 through which a tip 108 of the nib 104 moves or passes when the nib moves between a retracted position as shown in FIGS. 1A and 2A and an extended position as shown in FIGS. 1B and 2B. The barrel is generally referenced herein by numeral 102; however, in a number of embodiments such as shown in FIG. 3, the barrel 102 may include a lower barrel 102*a* and an upper barrel 102*b*, which portions may be unitary or individual elements.

Figure 3:
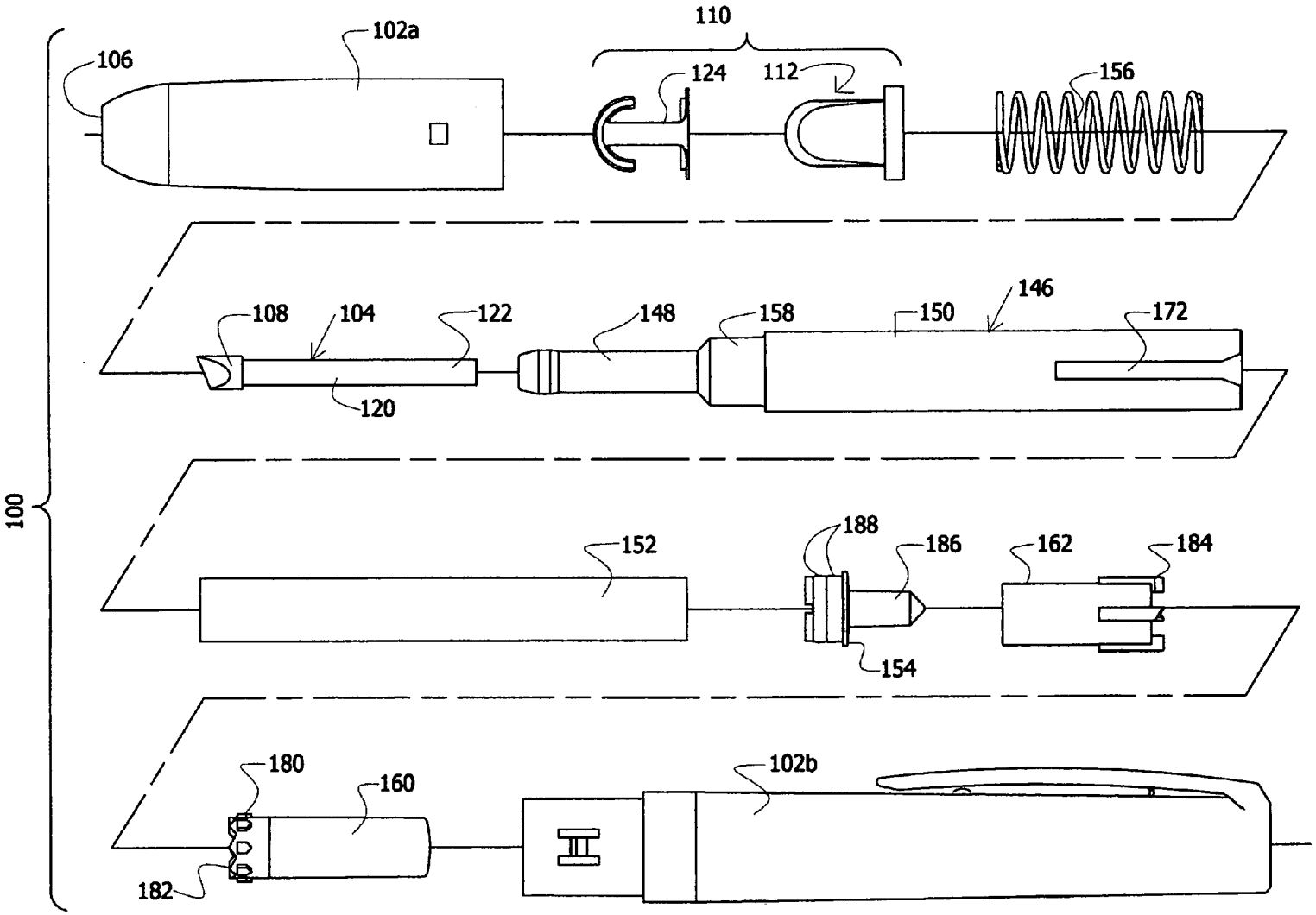
FIG. 3 is an exploded view illustrating a number of elements of a writing instrument according to some of the embodiments.

In a number of embodiments, the writing instrument 100 may include a seal assembly 110 disposed within the barrel 102 as shown in FIG. 3. The seal assembly 110 may be configured to seal at least the tip 108 of the nib 104 from ambient air via the front opening 106 of the barrel 102 when the nib 104 is in the retracted position. Accordingly, ink retained by the nib 104 or present within the lower barrel 102*a* may be substantially prevented from evaporating or permeating when the nib 104 is in the retracted position. Because of this sealing feature, the writing instrument 100 may be configured as a marker pen, a highlighter pen, dry-erase pen, or other pen which utilizes relatively volatile inks.

Figure 5:
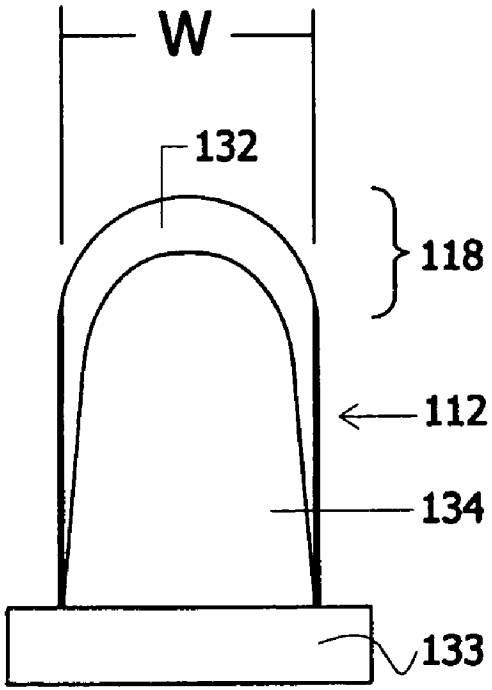
FIG. 5 is another side view of the body member of FIG. 4.
Figure 4:
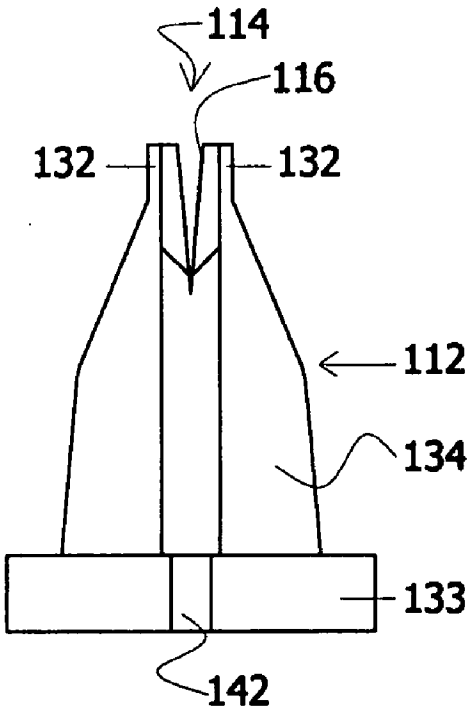
FIG. 4 is a side view of a number of embodiments of a body member of a seal for a capless writing instrument.
Figure 6:
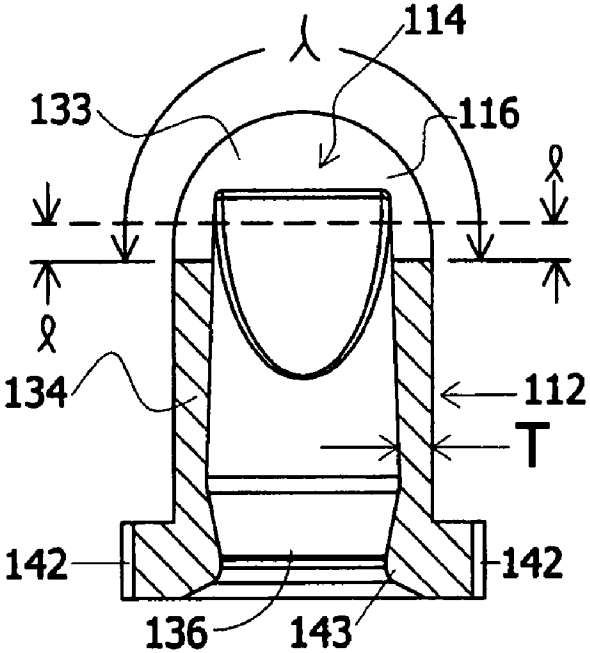
FIG. 6 is a cross-sectional view of the body member of FIG. 4.

Referencing FIG. 4, in many of the embodiments the seal assembly 110 may include a body member 112 having a movable gate 114 with a slit 116 through which the nib 104 is passable. As shown in FIG. 2, the movable gate 114 of the body member 112 may be defined to be in a closed position when the nib 104 is in the retracted position and in an opened position when the nib 104 moves to the extended position. In some of the embodiments, the body member 112 may include a substantially curvilinear, arcuate, or semicircular distal portion 118 as shown in FIG. 5 such that the movable gate 114 may be curvilinear. In these embodiments the slit 116 may have a length that includes an arc length $\lambda$ as shown in FIG. 6, while the body member 112 may have a width w as shown in FIG. 5.

Figure 7D:
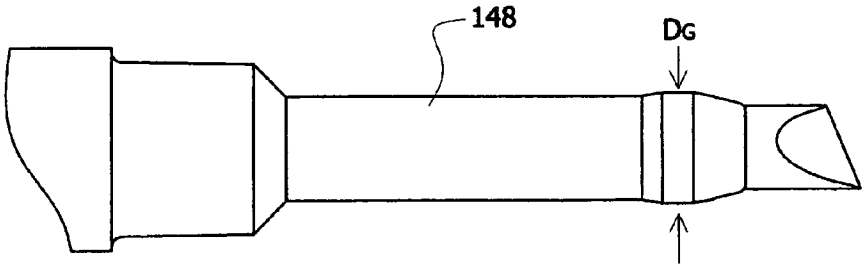
FIG. 7D is a fragmentary view of a nib received within a cartridge.
Figure 7C:
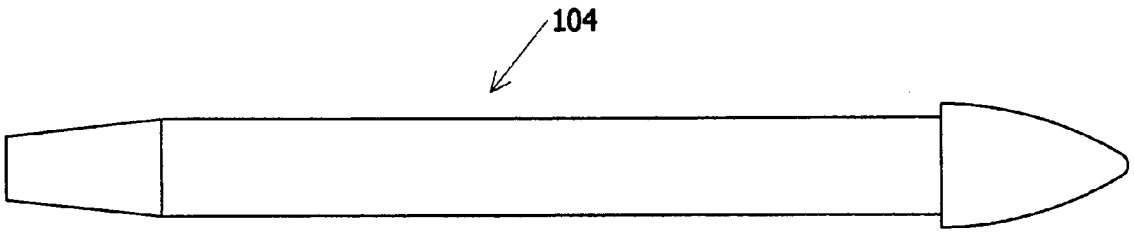
FIGS. 7A, 7B, and 7C are top, side, and bottom views, respectively, of a nib according to a number of embodiments.
Figure 7B:
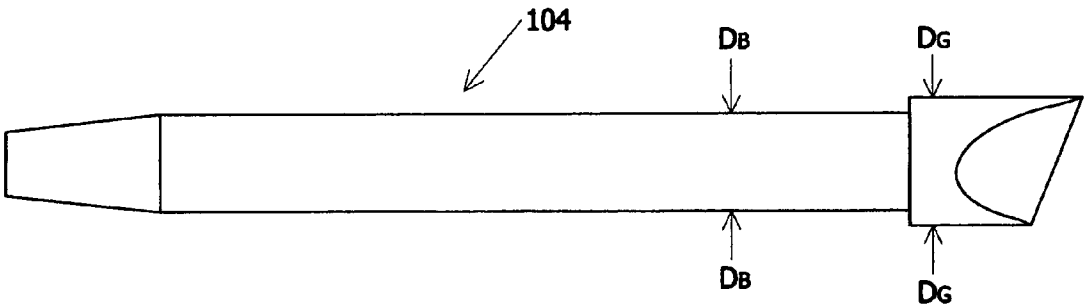
Figure 7A:
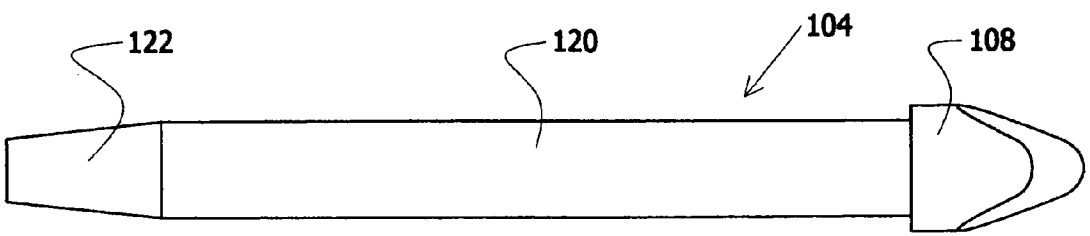

One of the advantages of the curvilinear embodiments is that the overall size or width w of the body member 112 may be minimized while the length $\lambda$ of the slit 116 may be maximized in relation to a size of the nib 104. This relationship may result in the nib 104 being subject to lower frictional forces while being extended and retracted. For example, as shown in FIGS. 7A, 7B, and 7C, in a number of embodiments the nib 104 may include a body 120 with the tip 108 and a tail 122. The nib 104 may be described has having a dimension $D_G$ of the tip 108 that moves through the movable gate 116 of the seal assembly 110. In the embodiment illustrated, the dimension $D_G$ may be a diameter; in other embodiments, the dimension $D_G$ may be a thickness. Generally speaking, the dimension $D_G$ may be defined as the greatest dimension of the nib 104. For example, as shown in FIG. 7D, the dimension $D_G$ may be defined as a thickness of a lower portion 148 of a cartridge 146 (which elements are discussed below) passing through the gate 114.

The length $\lambda$ of the slit 116 may be proportional to the dimension $D_G$ of the tip 108 of the nib 104. For example, the length $\lambda$ of the slit 116 when in a closed position may range from about 1.1 times to about 1.8 times greater than the dimension $D_G$ of the nib 104. In other embodiments, the length $\lambda$ of the slit 116 when in a closed position may be about 1.5 times greater than the dimension $D_G$ of the nib 104. In addition, the length $\lambda$ of the slit 116 when in a closed position may be proportional to the width w of the movable gate 114 or the body member 112; for example, the length $\lambda$ of the slit 116 may be about $\pi/2\times w$. In other embodiments, the length $\lambda$ of the slit 116 may include a curved portion with an arc length and one or more substantially linear or tangent portions as indicated by length l FIG. 6. In this embodiment, for example, the total length of the slit 116 may be defined as length $\lambda$ plus two times length l, or $\lambda+2l$.

Another one of the advantages of the curvilinear embodiments is that the slit 116 may be easily formed during manufacturing. For example, the body member 112 may be injected molded with the slit 116 being cut in a single secondary operation. Alternatively, the body member 112 may be compression molded with the slit 116 cut either during the molding process or in a subsequent step. In injection molding embodiments, the gating of the mold may be located on a side of the body member 112 and not at the tip (e.g., on the lips 132 described below), which is advantageous in yielding a better functioning gate 114.

In a number of embodiments, at least the movable gate 114 of the body member 112 of the seal assembly 110 may include an elastic material having a particular Shore A hardness so as to provide a certain level of resiliency. For example, some of the embodiments of the body member 112 may include a movable gate 114 including material having a Shore A hardness of about 30 to about 80. In other embodiments, a Shore A hardness of the material of the movable gate 114 may be about 40 to 50. In still other embodiments, the movable gate 114 may include a material having a Shore A hardness of about 65 to 80. In other embodiments, the Shore A hardness of the material of the gate 114 may be about 30 to 50.

To streamline production, the body member 112 may be unitary and made from a resilient material, examples of which include but are not limited to thermoplastic elastomers, synthetic elastomers, butyl rubber, silicone, and multiprene. Commercially available examples of such material are marketed under the following names: Trefsin®, Viton®, Kalrez®, Engage®, Sarlink®, Versalloy®, Santoprene®, and Vamac®. In addition to being substantially resilient, these materials may possess qualities that reduce permeation. In this regard, the body member 112 may have a wall thickness T as shown in FIG. 6 that reduces or minimizes permeation of ink therethrough. For example, the wall thickness T of the body member 112 may be about 1 millimeter (mm). In other embodiments, the wall thickness T of the body member 112 may be substantially uniform.

The wall thickness T of the body member 112 affects the rate of evaporation of the ink, namely, the greater the wall thickness T, the lower the evaporation rate. According to a number of embodiments, the wall thickness T is selected to minimize not only cost but also to minimize evaporation rate. Generally speaking, the wall thickness T is selected so that at a predetermined temperature, the evaporation rate of the ink is less than a predetermined percentage per period of time. In a number of embodiments, the body member 112 may have a wall thickness T that yields an evaporation rate of less than about 5% per week at a temperature of about 110 degrees Fahrenheit. In other embodiments, the body member 112 may have a wall thickness T that yields an evaporation rate of less than about 3% per week at a temperature of about 110 degrees Fahrenheit (° F.). In embodiments where the body member 112 includes Trefsin, a wall thickness of about 1 mm yields an evaporation rate of about 2% to about 3% per week at a temperature of about 110° F.

In still other embodiments, the body member 112 may be made from a material having a specific gravity in a predetermined range that yields a desired permeability and, therefore, a desired rate of evaporation. For example, the body member 112 may include a material having a specific gravity in the range of about 0.90 to about 1.25 using the standard test ASTM D-792. In other embodiments, the specific gravity of the material of the body member 112 may be in a range from about 0.98 to about 1.0. Examples of such materials include Sarlink at a specific gravity of 0.94; Santoprene or Trefsin at 0.97; Vamac at 1.03, and butyl rubber at 1.20.

In other embodiments, the body member 112 may be configured so that the movable gate 114 is biased in a closed position. For purposes of clarity and to illustrate the structure of the body member 112, the slit 116 is shown in FIG. 4 in an opened position. However, due to the resiliency of the material of the body member 112, the movable gate 114 may be biased so that the slit 116 remains in a closed position.

Figure 11:
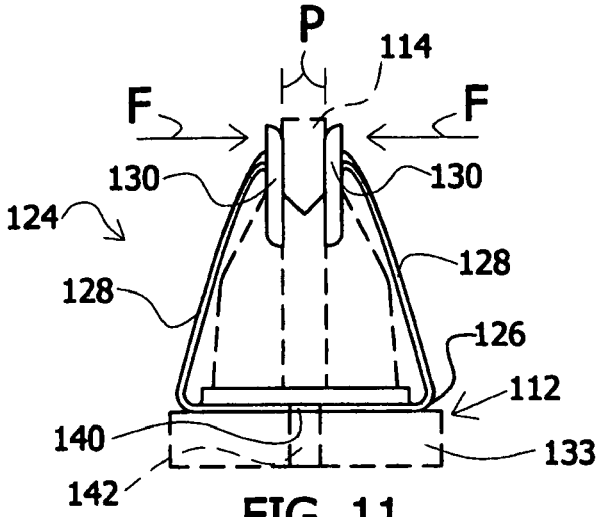
FIG. 11 is a side view similar to that of FIG. 9 in which a body member shown in phantom line is coupled to the spring member.
Figure 10:
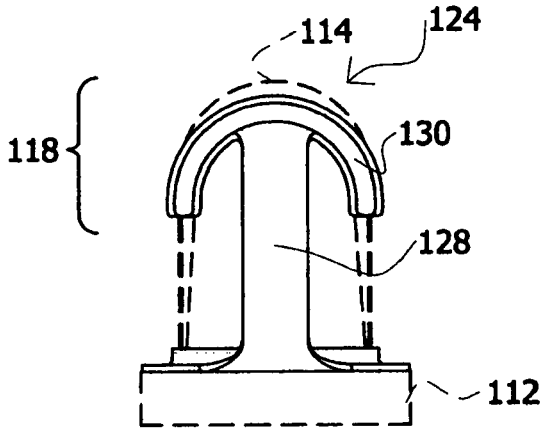
FIG. 10 is another side view of the spring member of FIG. 8.

To enhance the feature of biased in a closed position, in the embodiment shown in FIG. 3, the seal assembly 110 may also include a spring member 124. In a number of embodiments, the spring member 124 may be configured to urge or bias the body member 112 to be in a closed position. In the embodiments shown in FIGS. 8, 9, 10, 11, and 12, the spring member 124 may include a base 126 and a pair of arms 128. As shown in FIGS. 10 and 11, the spring member 124 may be disposed about the body member 112 for biasing the movable gate 114 in a closed position. In many of the embodiments, the spring member 124 may include spring steel so that the arms 128 providing an inward force F as shown in the embodiment of FIG. 11.

In other embodiments, each arm 128 may include a hand 130 for contacting or abutting the movable gate 114 as shown in FIGS. 10 and 11. In a number of embodiments, the hands 130 may be configured to complement the shape of the movable gate 114. For example, in embodiments in which the distal portion 118 of the movable gate 114 is substantially arcuate, the hands 130 may complementarily be arcuate in shape. In this regard, with further reference to FIGS. 4-6, the movable gate 114 may include a pair of lips 132 defined by the slit 116. When disposed about the body member 112, the hands 130 of spring member 124 may compress the lips 132 together to provide a seal. In some of the embodiments, the hands 130 may be configured to be substantially coextensive with outer surfaces of the lips 132 of the movable gate 114. In a number of embodiments, the seal assembly 110 may be configured to remain sealed at a predetermined range of pressures, which will be discussed in more detail below. In other embodiments, the hands 130 may each have a length that is greater than or equal to the length of the slit 116.

Figure 9:
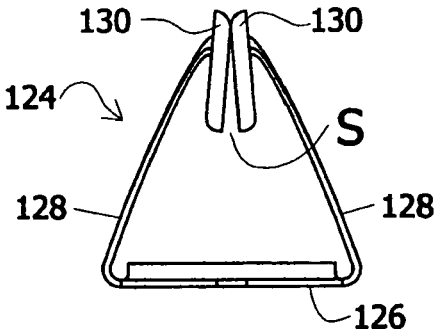
FIG. 9 is a side view of the spring member of FIG. 8.
Figure 12:
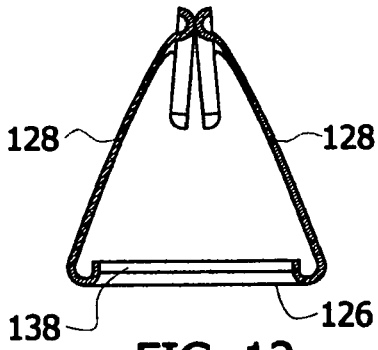
FIG. 12 is a cross-sectional view of a spring member taking along line 12-12 of FIG. 8.

In still other embodiments, the hands 130 of the spring member 124 may be canted when at rest and not mounted with the body member 112 as shown in FIG. 9. Accordingly, the hands 130 may be biased to contact each other at a top section thereof, with a bottom section thereof being separated as indicated by reference S. When the arms 128 are separated to receive the movable gate 114, the cant between the hands 130 disappears as shown in FIG. 11, and contact surfaces of the hands 130 are located in substantially parallel planes to each other, as indicated by lines P. This substantially parallel plane relationship enables the hands 130 to apply substantially equal pressure across the extent of the lips 132.

In the embodiments of FIGS. 4-6, the body member 112 may include a base 133, a central portion 134 disposed between the movable gate 114 and the base 133, and a cavity 136 formed through the base 133 and the central portion 134 through which the nib 104 is receivable. The central portion 134 may be substantially cylindrical or, alternatively, frustum shaped as shown in FIG. 4. In the embodiments shown in FIGS. 8-12, the base 126 of the spring member 124 may be circular and in the form of a collar with a central opening 138.

As shown in FIGS. 10 and 11, to assemble the embodiment of the seal assembly 110 of FIG. 3, the body member 112 may be inserted axially through the opening 138 of the spring member 124 with the arms 128 separated until the base 133 of the body member 112 abuts the base 126 of the spring member 124 and the movable gate 114 is disposed between the hands 130 of the arms 128. Accordingly, the axial arrangement of the body member 112 and the spring member 124 enables automated assembly.

Figure 8:
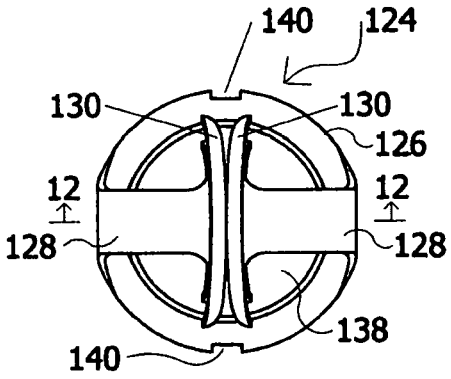
FIG. 8 is a top view of a spring member of a seal according to a number of embodiments.

In some of the embodiments, such as shown in FIGS. 8 and 11, the base 126 of the spring member 124 and the base 133 of the body member 112 may each include a pair of opposed notches 140 and 142, respectively, which align when the spring member 124 and the body member 112 are mounted, and which will be discussed in more detail below. Also discussed below are the embodiments in which the base 133 of the body member 112 may include an inner annular collar 143.

With further reference to FIGS. 2 and 3, the writing instrument 100 may include a tubular cartridge 146 for receiving the nib 104 and a supply of ink I. The cartridge 146 may have a lower portion 148 in which at least the body 120 of the nib 104 is received, and an upper portion 150 for receiving a capillary element 152. As shown in FIG. 2A, the tail 122 of the nib 104 may be engaged with the element 152 so that ink may travel to the tip 108 of the nib 104. An end of the upper portion 150 of the cartridge 146 may be sealed with a cap 154.

To protract and retract the nib 104, the writing instrument 100 may include a spring 156 disposed over the lower portion 148 and seated on a neck 158 of the cartridge 146. In addition, a plunger 160 may be disposed within the upper barrel 102*b* for actuating the writing instrument in conjunction with a gear element 162.

The lower and upper barrels 102*a* and 102*b* may include engaging structure for connecting the two barrels together. For example, as shown in the embodiment in FIGS. 13A and 13B and FIGS. 14A and 14B, the upper barrel 102*b* may include one or more resilient prongs 164 for engaging with a corresponding number of sockets 166. An inner surface of the lower barrel 102*a* may include slots 167 for respectively guiding the prongs 164 to the sockets 166. Also shown, the upper barrel 102*b* may have a neck 168 for being received within a collar 170 of the lower barrel 102*a*, as shown in FIG. 2B.

Figure 15:
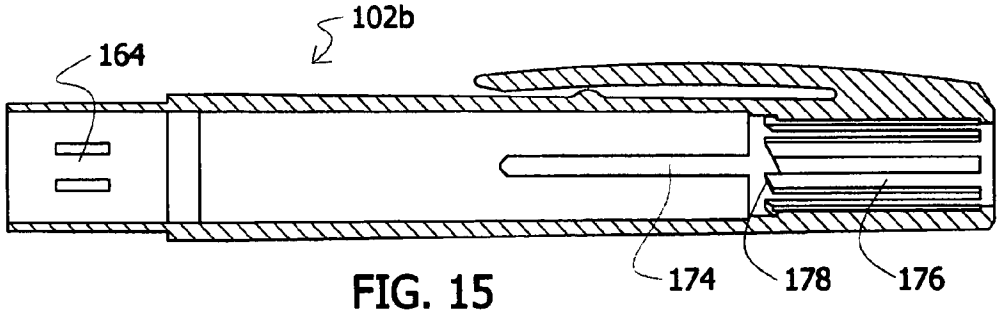
FIG. 15 is a cross-sectional view of an upper barrel taken along line 15-15 of FIG. 13A.
Figure 13A:
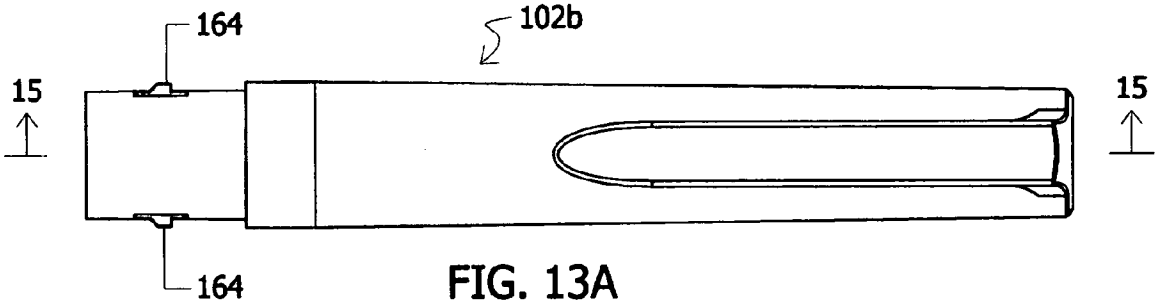
FIGS. 13A and 13B are top and side view, respectively, of an upper barrel of a writing instrument.
Figure 13B:
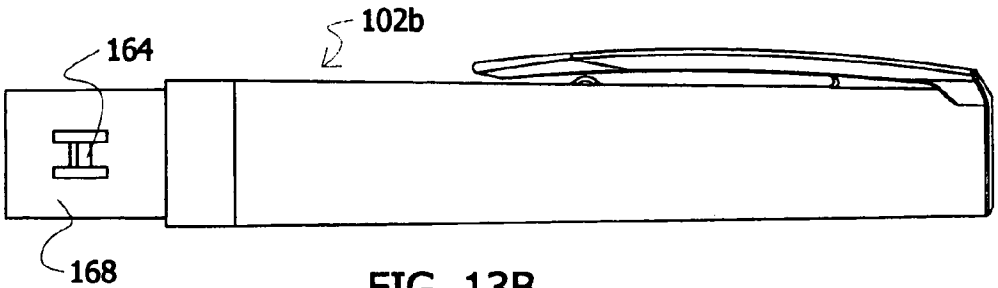
Figure 14A:
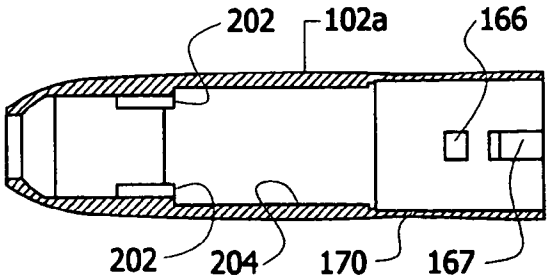
FIGS. 14A and 14B are cross-sectional top and side views, respectively, of a lower barrel of a writing instrument.
Figure 14B:
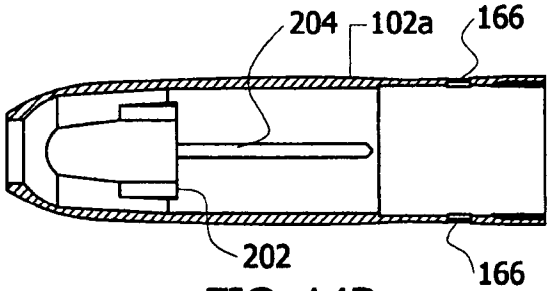
Figure 16B:
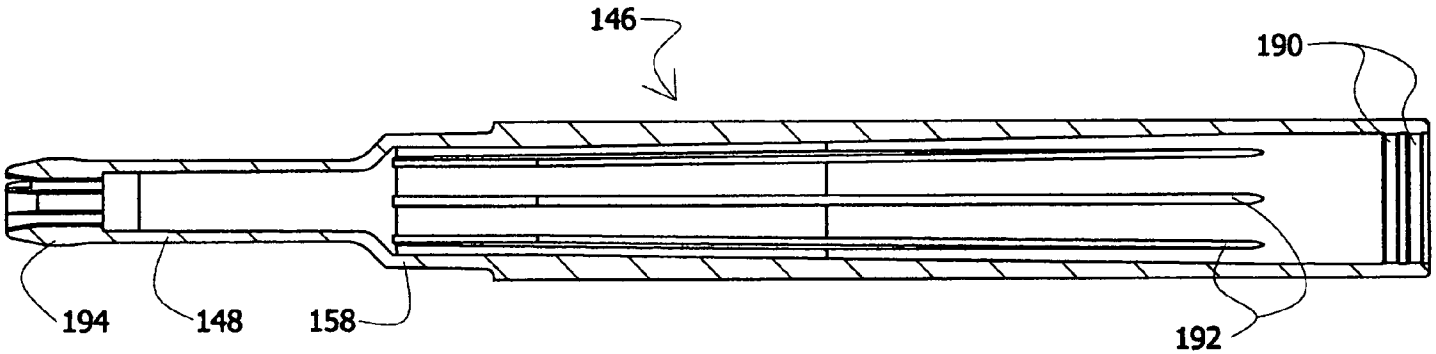
FIG. 16B is a cross-sectional view of a cartridge according to a number of embodiments.
Figure 16A:
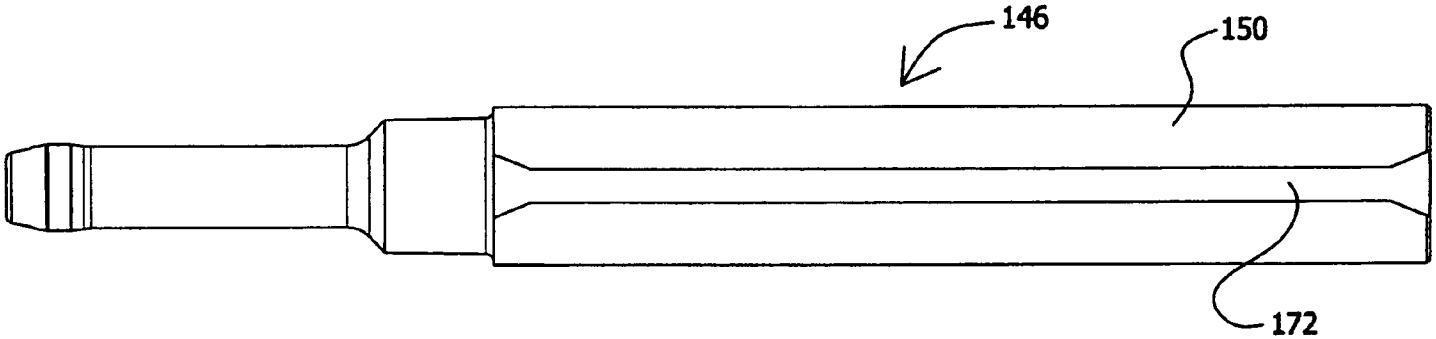
FIG. 16A illustrates a cartridge of a writing instrument according to a number of embodiments.

Referencing FIGS. 3 and 15, the cartridge 146 may include one or more slots 172 on the upper portion 150 thereof for slidably engaging with one or more guides 174 complementarily disposed on an inner surface of the upper barrel 102*b*. In some embodiments the slots 172 may be a diametrically opposed relationship. The guides 174 ensure during protraction and retraction that the cartridge 146 and, accordingly, the nib 104 do not rotate axially but rather translate linearly. In addition, the slots 172 and the guides 174 also orient the upper barrel 102*b* and the cartridge 146 in a relatively rotatably fixed relationship. In some of the embodiments, such as shown in FIG. 3, the slots 172 may have a discrete length. In other embodiments, such as shown in FIG. 16A, the slots 172 may extend the length of the upper portion 150 of the cartridge 146 to enable rear-loading during the manufacture of the writing instrument 100.

Also shown in the embodiment of FIGS. 3 and 15, the upper barrel 102*b* may include a rail structure 176 with chamfers 178 disposed on an inner surface of the upper barrel 102*b* for slidably engaging with annular bosses 180 disposed on the plunger 160. In addition, the plunger 160 may include a gear surface 182 disposed on a lower end thereof for engaging in a ratchet-like manner with cams 184 of the gear element 162 as shown in FIG. 2A. The cams 184 also engage the chamfers 178 of the rail structure 176 of the upper barrel 102*b* when the cartridge 146 is in the extended position as shown in FIG. 2B.

With continued reference to FIG. 3, in other embodiments the cap 154 may include an upper post 186 for being received within a tubular gear element 162 as also particularly shown in FIG. 2A. The cap 154 may also include a plurality of annular bosses 188 for sealingly engaging with complementary annular grooves 190 formed on an inner surface of an upper end of the cartridge 146 as shown in FIG. 16B. Also shown in FIG. 16B, the cartridge 146 may include a plurality of ribs 192 for engaging with the capillary element 152 as shown in FIGS. 2A and 2B. In other embodiments, the cartridge 146 may include an annular chamfer 194 disposed about a lower end of the lower portion 148 thereof. The nib 104 may be received within the lower portion 148 of the cartridge 146, with the tip 108 abutting a lower end of the cartridge 146, the body 120 extending through the lower portion 148, and the tail 122 projecting into the capillary element 152 as shown in FIGS. 2A and 2B.

Figure 17C:
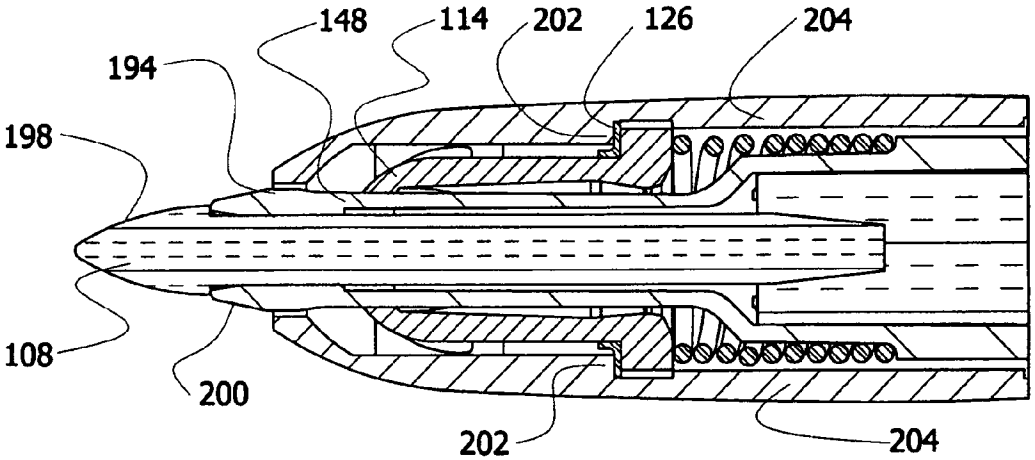
FIGS. 17A, 17B, and 17C are cross-sectional views of a nib in a retracted position, an intermediate position in which a vent is formed, and an extended position, respectively.
Figure 17A:
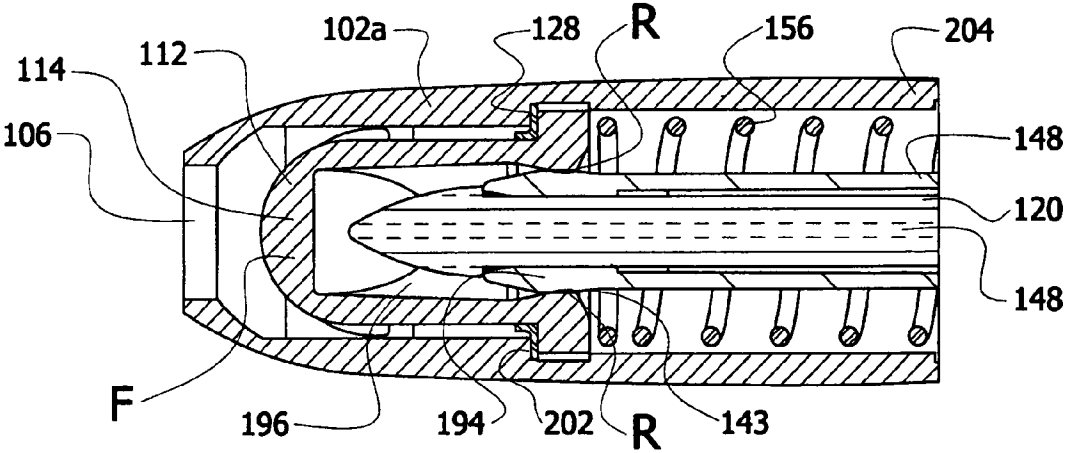
Figure 17B:
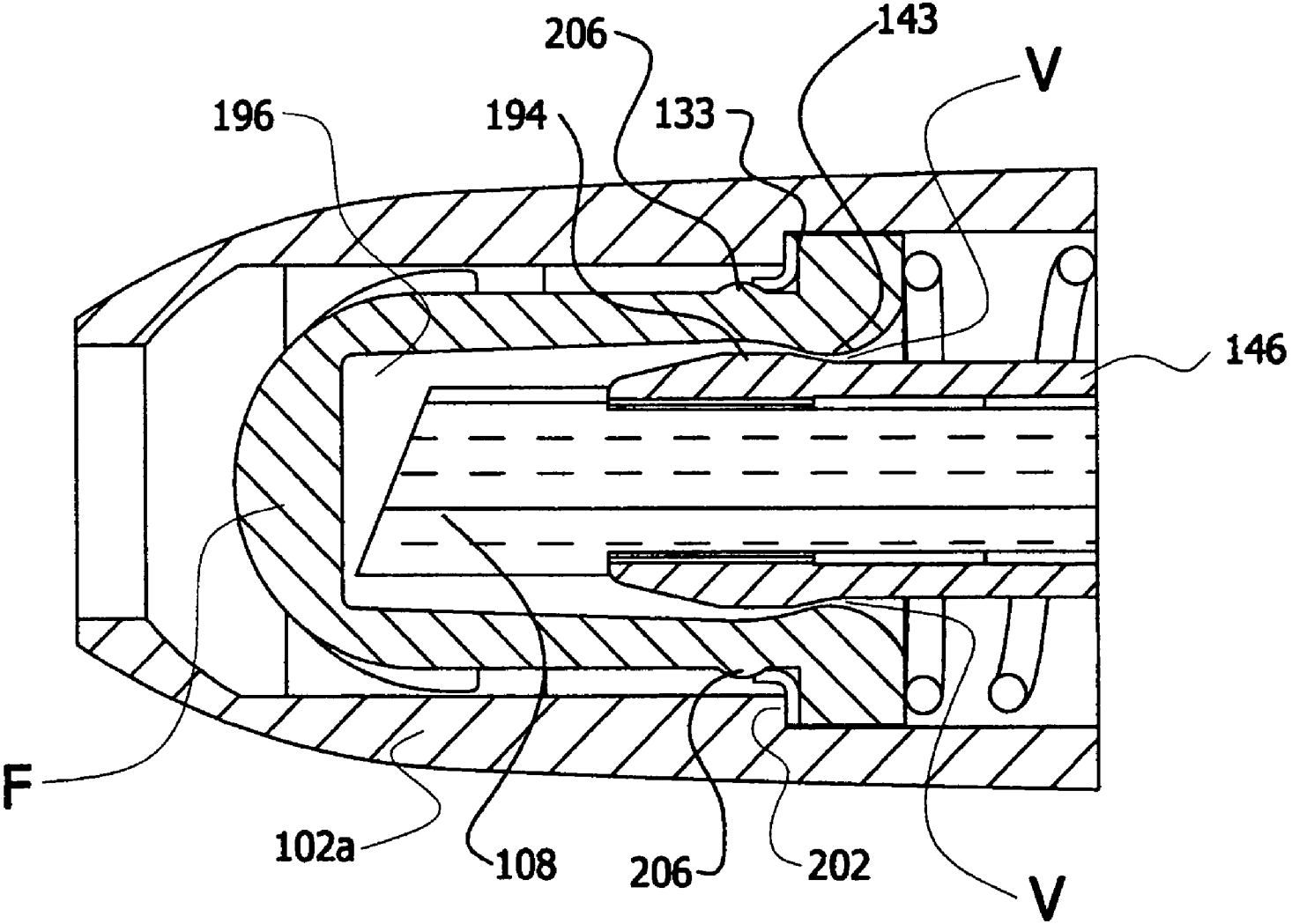
Figure 17D:
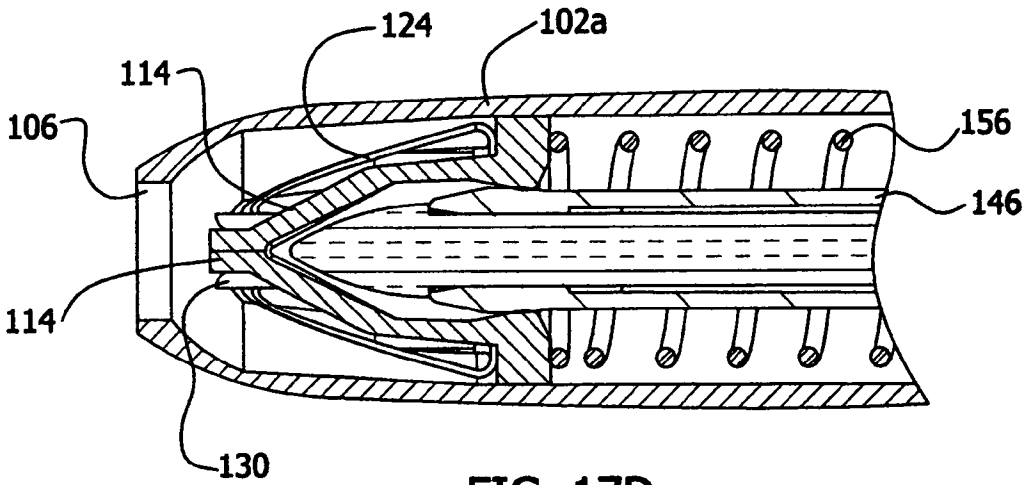
FIGS. 17D and 17E are cross-sectional views of a nib in a retracted position and an extended position, which views are rotated 90 degrees from the views shown in FIGS. 17A and 17C, respectively.

With reference to FIGS. 17A, 17B, 17C, 17D, and 17E, in a number of embodiments the writing instrument 100 may be configured so that the seal assembly 110 is able to exhaust any gas resulting from pressure within the seal assembly 110 that may have increased while the cartridge 146 and nib 104 were in the retracted position. More specifically, when in the retracted position as shown in FIGS. 17A and 17D, the annular chamfer 194 of the cartridge 146 is urged against and compresses outwardly the annular collar 143 of the body member 112 of the seal assembly 110, thereby creating a rear seal indicated by reference R. A front seal F is formed by the movable gate 114 as described above. The two seals R and F define a sealed chamber 196 within the body member 112.

Due to volatility of the ink utilized by the writing instrument 100, the pressure within the chamber 196 may increase and exceed the ambient pressure. Accordingly, if unvented, the pressurized gas would vent through the movable gate 114 when the nib 104 is moved to the extended positioned, which may inadvertently spray ink on to a writing surface. In a number of embodiments, the seals R and F, particularly the front seal F, may be configured to provide a seal at a pressure difference defined between the pressure within the chamber 196 and ambient pressure of less than about 5 pounds per square inch (PSI). Other embodiments of the seal assembly 110 may be configured to remain sealed at higher pressure differences. In still other embodiments, the seal assembly 110 is configured to remain sealed at about 2 PSI or less.

According to a number of embodiments, when the nib 104 is initially moved to begin protraction and prior to the tip 108 of the nib 104 breaking the front seal F as shown in FIG. 17B, the annular chamfer 194 is moved forward from the annular collar 143, thereby breaking the rear seal R and defining a vent V between the cartridge 146 and the body member 112. The vent V allows gas from the chamber 196 to exhaust upward into the inside of the front barrel 102*a*. In a number of embodiments, such as shown in FIG. 17B, gas from the chamber 196 is able to vent annularly or circumferentially about the cartridge 146, thereby maximizing the volume of the vent V or the rate at which the gas is able to vent.

Figure 17E:
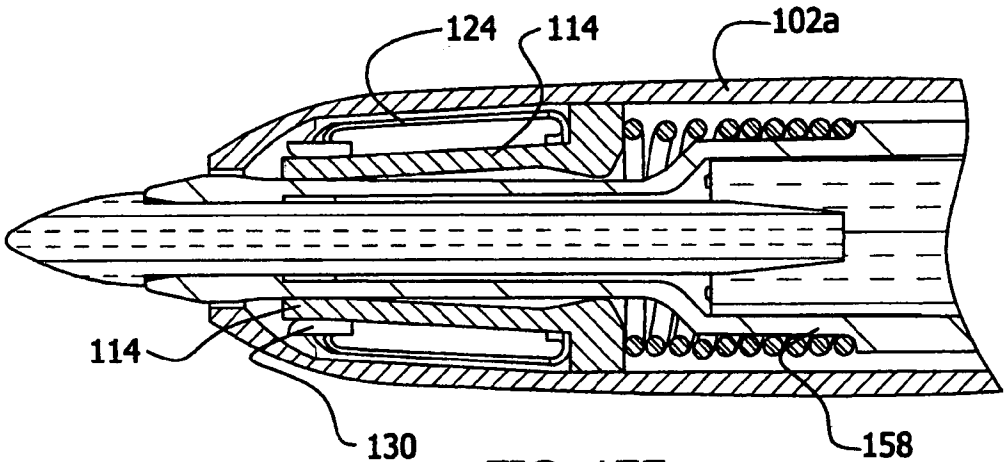

As the nib 104 continues to be extended, the tip 108 breaks the front seal F. The annular chamfer 194 of the cartridge 146 may also then be urged through and assist in opening the slit 116 as shown in FIGS. 17C and 17E, which may also reduce deformation of the nib 104 caused by the seal assembly 110. In some of the embodiments, the tip 108 may have a curved or sloping outer surface 198 that is similar to or substantially tangent with an initial sloped surface 200 of the chamfer 194. Accordingly, the composite sloping outer surface 198 and 200 of the tip 108 of the nib 104 and the lower portion 148 of the cartridge 146 provides a relatively smooth wedge-like outer surface for urging through the movable gate 114 of the seal assembly 110.

Figure 18:
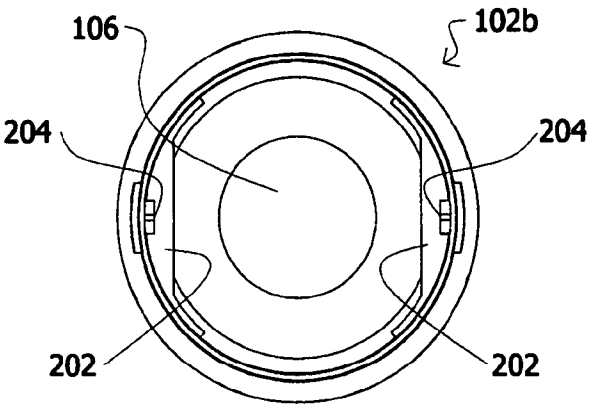
FIG. 18 is a view looking axially into the front barrel of FIGS. 14A and 14B.

As shown in FIGS. 14, 17, and 18, the lower barrel 102*a* may include a pair of shoulders 202 and a pair of rails 204 formed diametrically oppositely on an inner surface thereof. As mentioned above, the spring member 124 may include notches 140. During fabrication, the notches 140 may be aligned with any notches 142 formed in the body member 112 as shown in FIG. 11, with the seal assembly 110 then being inserted forwardly through the lower barrel 102*a* with the notches 140 slidingly engaging the rails 204 until the base 126 of the spring member 124 abuts the shoulders 202 as shown, e.g., in FIG. 17C. The arrangement of the rails 204 and notches 40 maintains the lower barrel 102*a* and the seal assembly 110 in a substantially rotationally fixed relationship.

In addition, the compression spring 156 may abut an end of the base 133 of the body member 112 to maintain the seating of the base 126 of the spring member 124 against the shoulders 202 as shown in FIG. 17B. Alternatively, the spring 156 may be positioned on a seat (not shown) formed within the lower barrel 102*a* to reduce compression of the base 133 of the body member 114. With reference to FIG. 17B, in some of the embodiments the body member 112 may include an annular seat 206 defined on an outer surface thereof for retaining the base 126 of the spring member 124 during subassembly of the seal assembly 110.

Those skilled in the art will understand that the preceding embodiments of the writing instrument 100 provide the foundation for numerous alternatives and modifications thereto. For example, in addition to volatile-ink writing instruments, the writing instrument 100 of the invention may be configured as any type of writing instrument such as a roller-ball pen or a ballpoint pen, and may be configured as any type of device for transferring fluids or powders. These other modifications are also within the scope of the invention. Accordingly, the writing instrument of the invention is not limited to that precisely as shown and described above.

What is claimed is:

1. A writing instrument comprising:

a barrel having a front opening;

a nib having a dimension and movable through the front opening of the barrel between a retracted position and an extended position;

a seal assembly located within the barrel and including a body member having a movable gate capable of forming an opening through which the nib may extend, the movable gate defining a front seal for separating the nib from ambient air flow from the front opening of the barrel when the nib is in the retracted position, the seal assembly further including a rear seal, a tip of the nib positioned within the body member between the front seal and the rear seal when the nib is in the retracted position, wherein the nib while moving to the extended position breaks the front seal; the rear seal being broken prior to the nib breaking the front seal to form a vent between the cartridge and the body member; and wherein the movable gate is biased in a closed position and has a dimension when in the closed position that is at least about 1.1 times greater than the dimension of the nib.

2. The retractable writing instrument of claim 1 wherein the movable gate is formed from an elastic material.

3. The retractable writing instrument of claim 1 wherein the movable gate includes a slit with a predetermined length, wherein the nib has a predetermined thickness, and wherein the length of the slit is at least about 1½ times greater than the thickness of the nib.

4. The retractable writing instrument of claim 1 wherein the seal assembly further includes a spring member disposed about the body member for biasing the movable gate in a closed position.

5. The retractable writing instrument of claim 1 wherein the movable gate includes a slit defining a pair of lips.

6. The retractable writing instrument of claim 5 wherein the seal assembly further comprises a spring member disposed about the body member; the spring member including a pair of arms for urging the lips together to close the slit of the movable gate.

7. The retractable writing instrument of claim 6 wherein:

the body member further includes a base and a central portion disposed between the movable gate and the base; and the spring member further includes a base to which the arms are attached and disposed about the base of the body member.

8. The retractable writing instrument of claim 7 wherein the arms each include a hand for contacting a respective one of the lips of the movable gate.

9. The retractable writing instrument of claim 8 wherein each of the hands is substantially coextensive with the respective one of the lips.

10. The retractable writing instrument of claim 8 wherein each of the hands has a length that is greater than or equal to the length of the slit.

11. The retractable writing instrument of claim 1 further comprising a cartridge containing ink and being in fluid communication with the nib, the cartridge being located within the barrel of the retractable writing instrument.

12. The retractable writing instrument of claim 11 wherein the cartridge includes an annular chamfer on an outer surface thereof and the body member includes an annular collar on an inner surface thereof;

the chamfer abutting the collar when the nib is in the retracted position to form the rear seal therebetween.

13. The retractable writing instrument of claim 12 wherein the nib contacts the movable gate while moving to the extended position;

the chamfer being free of contact with the collar when the nib is moved from the retracted position but prior to contacting the movable gate to provide the vent.

14. The retractable writing instrument of claim 13 wherein the vent is defined annularly around the cartridge.

15. A writing instrument comprising:

a barrel having a front opening;

a nib movable through the front opening of the barrel between an extended position and a retracted position; and a seal assembly disposed within the barrel and including a body member having a movable gate with a slit through which the nib is passable, the seal assembly creating a front seal via the front opening of the barrel and a rear seal via an outer surface of a cartridge in contact with an inner surface of the body member, a tip of the nib positioned within the body member between the two seals when the nib is in the retracted position, wherein the nib is urged through the slit while moving to the extended position to break the front seal; the rear seal being broken prior to the nib breaking the front seal to form a vent between the cartridge and the body member;

the movable gate being in a closed position when the nib is in the retracted position and in an opened position when the nib moves to the extended position; and at least a portion of the movable gate being curved.

16. The retractable writing instrument of claim 15 wherein at least a portion of the movable gate is substantially semicircular.

17. The retractable writing instrument of claim 15 wherein the seal assembly is biased to remain in a closed position while subject to a pressure difference between each side of the slit of less than about 5 pounds per square inch (PSI).

18. The retractable writing instrument of claim 15 wherein the body member is formed from an elastic material having a Shore A hardness of about 30 to about 50.

19. A writing instrument comprising:

a barrel having a front opening;

a nib for moving through the front opening of the barrel between an extended position and a retracted position;

a cartridge for receiving the nib and for holding a supply of ink; and a body member being received within the barrel and having a slit through which the nib is passable;

when the nib is in the retracted position, the slit is biased in a closed position to form a front seal and an outer surface of the cartridge contacts an inner surface of the body member to form a rear seal such that a tip of the nib is positioned within the body member between the two seals; and wherein the nib is urged through the slit while moving to the extended position to break the front seal; the rear seal being broken prior to the nib breaking the front seal to form a vent between the cartridge and the body member.

20. The retractable writing instrument of claim 19 wherein the cartridge includes an annular chamfer disposed on the outer surface thereof and the body member includes an annular collar formed on the inner surface thereof;

the chamfer abutting the collar when the nib is in the retracted position to form the rear seal.

21. The retractable writing instrument of claim 19 further comprising a spring member for biasing the slit in a closed position when the nib is in the retracted position.

22. A device capable of transferring volatile fluids or powders through a tip, the device comprising:

a barrel having a front opening;

a tip movable through the front opening of the barrel between an extended position and a retracted position; and a seal assembly disposed within the barrel and including a body member having a movable gate through which the tip is passable in the extended position, and at least a portion of the movable gate being curved and forming a front seal capable of sealing the tip from ambient air via the front opening of the barrel when the tip is in the retracted position, the seal assembly further including a rear seal, a tip of the nib positioned within the body member between the front seal and the rear seal when the nib is in the retracted position, wherein the nib while moving to the extended position breaks the front seal; the rear seal being broken prior to the nib breaking the front seal to form a vent between the cartridge and the body member.

23. The device according to claim 22, wherein the seal assembly includes a spring member adapted to associate with the movable gate of the body member to bias the movable gate to a closed position.

24. The device according to claim 23, wherein the movable gate has a slit defining a pair of lips which are curved.

25. The device according to clam 24, wherein the spring member has a pair of hands adapted to associate with the pair of lips to bias the pair of lips to a closed position.

26. The device according to claim 25, wherein the pair of hands are curved to correspond with the pair of lips which are curved.

27. The device according to claim 25, wherein each of the hands has a length that is at least equal to the length of the slit.

28. The device according to claim 22, wherein the body member further includes a base that is adjacent to the tip, and when the tip is in a retracted position, the tip is between the movable gate and the base of the body member.

29. A seal assembly adapted to separate a tip from ambient air, the tip adapted to transfer fluids or powders through the seal assembly, the seal assembly comprising:

a body member having a movable gate with a curve configuration, the movable gate adapted to move between an opened position and a closed position , wherein in the opened position, the tip may extend through the movable gates while in the closed position, the body member substantially defining a front seal that separates the tip from ambient air and a rear seal, the tip of the nib positioned within the body member between the front seal and the rear seal when moveable gate is in the closed position, wherein the nib while moving to an extended position breaks the front seal; the rear seal being broken prior to the nib breaking the front seal to form a vent; and a spring member adapted to associate with the movable gate of the body member to bias the movable gate in the closed position.

30. The seal assembly according to claim 29, wherein the body member further includes a base, and when the movable gate is in the closed position, the tip is between the movable gate and the base of the body member.

31. The seal assembly according to claim 29, wherein the movable gate has a slit defining a pair of lips which are curved.

32. The seal assembly according to clam 31, wherein the spring member has a pair of hands adapted to associate with the pair of lips to bias the pair of lips in the closed position.

33. The seal assembly according to claim 32, wherein the pair of hands are curved to correspond with the pair of lips which are curved.

34. The seal assembly according to claim 33, wherein each of the hands has a length that is at least equal to the length of the slit.

35. A seal assembly adapted to separate a tip from ambient air, the tip adapted to transfer fluids or powders through the seal assembly, the seal assembly comprising:

a body member adapted to seal the tip between a movable gate and a base, the base adjacent to the tip, wherein the movable gate is adapted to move between an opened position and a closed position, and in the opened position, the tip may extend through the movable gate, while in the closed position, the movable gate and the base form a front seal that substantially seals the tip from ambient air and a rear seal, the tip of the nib positioned within the body member between the front seal and the rear seal when moveable gate is in the closed position, wherein the nib while moving to an extended position breaks the front seal; the rear seal being broken prior to the nib breaking the front seal to form a vent; and a spring member adapted to associate with the movable gate of the body to bias the movable gate in the closed position.

36. The seal assembly according to claim 35, wherein the movable gate has a curved configuration.

37. The seal assembly according to claim 35, wherein the movable gate has a slit defining a pair of lips which are curved.

38. The seal assembly according to clam 37, wherein the spring member has a pair of hands adapted to associate with the pair of lips to bias the pair of lips in the closed position.

39. The seal assembly according to claim 38 wherein the pair of hands are curved to correspond with the pair of lips which are curved.

40. The seal assembly according to claim 38, wherein each of the hands has a length that is at least equal to the length of the slit.

41. A device capable of transferring volatile fluids or powders through a tip, the device comprising:

a barrel having a front opening;

a tip movable through the front opening of the barrel between an extended position and a retracted position; and a seal assembly for substantially preventing volatile fluids or powders from evaporating through the tip in the retracted position and allowing the tip to extend through the front opening of the barrel in the extended position, the seal assembly including a front seal and a rear seal, the tip positioned between the front seal and the rear seal when the tip is in the retracted position, wherein the tip while moving to an extended position breaks the front seal; the rear seal being broken prior to the tip breaking the front seal to form a vent.

42. The device according to claim 41, the seal assembly disposed within the barrel and including a body member having a movable gate through which the tip is passable in the extended position, and at least a portion of the movable gate being curved and capable of sealing the tip from ambient air via the front opening of the barrel when the tip is in the retracted position.

43. The device according to claim 41, including a spring member for assisting the seal assembly to substantially prevent the volatile fluids or powders from evaporating through the tip.

* * * * *

UNITED STATES PATENT AND TRADEMARK OFFICE

CERTIFICATE OF CORRECTION

PATENT NO. : 7,341,388 B2
APPLICATION NO. : 10/864096
DATED : March 11, 2008
INVENTOR(S) : Craig D. Carroll It is certified that error appears in the above-identified patent and that said Letters Patent is hereby corrected as shown below:

Title page, item [57] Abstract, third line, “folding” should be changed to -- holding --

Title page, item [57] Abstract, 9th sentence, “IN” should be changed to -- In --

In Claim 25, column 11, line 44, “clam” should be changed to -- claim --

In Claim 29, column 11, line 64, “gates” should be changed to -- gate --

In Claim 32, column 12, line 16, “clam” should be changed to -- claim --

In Claim 38, column 12, line 50, “clam” should be changed to -- claim --

Signed and Sealed this

Fourteenth Day of October, 2008

JON W. DUDAS
*Director of the United States Patent and Trademark Office*